US005271680A

United States Patent [19]

Fukuoka et al.

[11] Patent Number: 5,271,680

[45] Date of Patent: Dec. 21, 1993

[54] DAISY-WHEEL TYPE PRINTER HAVING HOLDER MOVABLE BETWEEN PRINT POSITION AND ERASE POSITION

[75] Inventors: Mutsuo Fukuoka; Hiroki Kawamura, both of Aichi, Japan

[73] Assignee: Brother Kogyo Kabushiki Kaisha, Aichi, Japan

[21] Appl. No.: 997,869

[22] Filed: Dec. 29, 1992

[30] Foreign Application Priority Data

Jan. 8, 1992 [JP] Japan ..... 4-1343
Jan. 9, 1992 [JP] Japan ..... 4-2354

[51] Int. Cl.[5] ..... B41J 11/60
[52] U.S. Cl. ..... 400/697.1; 400/214
[58] Field of Search ..... 400/212, 214, 216.1, 400/223, 225, 695, 696, 697, 697.1

[56] References Cited

U.S. PATENT DOCUMENTS 4,472,073 9/1984 Valle et al. ..... 400/697.1
4,573,813 3/1986 Aoki et al. ..... 400/697.1
4,613,248 9/1986 Iwase et al. ..... 400/697.1
4,637,744 1/1987 Valle et al. ..... 400/697.1
4,728,208 3/1988 Iwase et al. ..... 400/697.1
4,840,505 6/1989 Kurokawa ..... 400/697.1
5,160,207 11/1992 Woo ..... 400/697.1
5,171,094 12/1992 Kawamura ..... 400/697

*Primary Examiner*—Edgar S. Burr
*Assistant Examiner*—Ren Yan
*Attorney, Agent, or Firm*—Oliff and Berridge

[57] ABSTRACT

A daisy-wheel type printer having a position shifting mechanism for selectively positioning a ribbon cassette and an erase ribbon at a given place in front of a platen, a print hammer driving mechanism, a print ribbon takeup mechanism and an erase ribbon takeup mechanism. These mechanisms are driven by a single drive motor through a plurality of cams mounted on a drive shaft of the drive motor. The drive motor is carried on a carriage body laterally movable along the platen. The carriage body also carries a holder member on which the ribbon cassette and the erase ribbon are mounted. The holder member is pivotally supported to a support shaft and has a printing pivot position and an erase pivot position. The plurality of cams includes a lifter cam, a print cam and a ribbon supply cam. The lifter cam includes a plurality of cam portions.

13 Claims, 10 Drawing Sheets

DAISY-WHEEL TYPE PRINTER HAVING HOLDER MOVABLE BETWEEN PRINT POSITION AND ERASE POSITION

BACKGROUND OF THE INVENTION

The present invention relates to a daisy-wheel type printer, and more particularly to a type thereof in which a holder member which mounts thereon a print ribbon and an erase ribbon is pivoted upwardly from a printing position for character erasing, and is pivoted downwardly when the erase operation is terminated.

There are well known daisy-wheel-type electronic typewriters capable of printing and erasing characters. The typewriters include a print hammer, a type wheel, a print ribbon, an erase ribbon, and drive mechanisms therefor, which are all mounted on a carriage.

In the electronic typewriter of this type, a holder member mounts thereon a printing ribbon and an erase ribbon. Further, the typewriter includes a position shifting mechanism for shifting a position of the holder member between a printing position where the print ribbon is brought into confrontation with the print hammer for character printing and an erase position where the erase ribbon is brought into confrontation with the print hammer for erasing. The typewriter also includes a print hammer driving mechanism and a print ribbon take-up mechanism. These mechanisms are driven by respective drive motors.

SUMMARY OF THE INVENTION

The inventor of the presentinvention has proposed an electronic typewriter in which the position shifting mechanism, the print hammer driving mechanism, the print ribbon takeup mechanism, and an erase ribbon takeup mechanism are actuated by a single motor mounted on the carriage body, so that the typewriter can be manufactured less costly and the carriage can be rendered compact.

In the proposed electronic typewriter, the motor has an output shaft to which are integrally provided a print cam for driving the print hammer and a lifter cam for lifting the holder member to the erase position. Further, the lifter cam is provided with a reference cam for maintaining the holder member at its printing position, an outer cam for maintaining the holder member at its erase position, and slanting first and second slant cams connecting the reference cam to the outer cam surface. Furthermore, a follower pin is attached to the holder member. The follower pin is movable in an axial direction thereof and is in sliding contact with the lifter cam.

Upon rotation of the motor in a normal direction, the follower pin is slidingly moved along the reference cam so as to maintain the printing position of the holder member for performing a printing operation with the printing hammer by way of the printing cam. By the predetermined angular rotation of the motor in a reverse and normal direction, the follower pin is axially moved along the slanting portion of the first and second slant cams, so that the pin reaches the outer cam. The pin is further slidingly moved over the outer peripheral cam so as to lift-up the holder member from the printing position to the erase position and to maintain the erase position for performing erase operation.

In the proposed electronic typewriter described above, the erase ribbon is lifted up to the erase position by sliding movement of the follower pin over the first and second slant cams. During this lifting, the follower pin portion in sliding contact with the first and the second slant cams is imparted with a combined weight of the holder member, the printing ribbon and the erase ribbon. Accordingly, axial movement of the follower pin may be degraded or restrained due to frictional resistance occurring between the follower pin and the first and second slant cams.

Due to this frictional resistance, the follower pin may not reach the outer cam, but may be returned back to the reference cam. Consequently, the erase ribbon cannot be lifted up to the erase position to render the erase operation inoperative. In another occasion, the follower pin may be returned back to the first and second slant cams from the outer peripheral cam, so that the vertical vibration may occur in the erase ribbon. As a result, the erase ribbon cannot be accurately positioned in front of a character to be erased. Thus, stabilized erasing operation can not be performed.

In another aspect, the print ribbon take-up mechanism in the proposed typewriter includes a first swing member, a ribbon supply cam and a second swing member provided at the holder member. The ribbon supply cam is provided integrally with the lifter cam for swinging the first swing member. When the holder member has the printing position, the first swing member is swingingly moved to engage the second swing member to swing the latter so as to take-up the ink ribbon.

Upon termination of the erase operation, the motor is reversely rotated to move the follower pin toward the reference cam through sliding movement of the follower pin over the second slant cam. In accordance with the movement of the follower pin, the holder member is gradually moved downwardly from its erase position to the printing position.

Here, the first swing member is swingingly moved even during the erase operation, since the ribbon supply cam is provided integrally with the lifter cam. Therefore, after the completion of erase operation, the second swing member may ride onto the swinging first swing member during the downward movement of the holder member from the erase position to the printing position. If such riding occurs, the holder member cannot be lowered to the printing position, which in turn, renders subsequent printing operation inoperative.

It is, therefore, an object of the present invention to provide a printer which provides stabilized engagement of a first cam follower (the above described follower pin) with a second cam (corresponding to the above described outer cam) so as to surely position an erase ribbon at its erase position.

Another object of the invention is to provide such printer in which the holder having its erase position can surely be lowered or moved to its printing position without any mechanical interference of swing members.

These and other objects of the present invention will be attained by providing a printer including a pair of side walls, a platen laterally extending between the side walls, a guide shaft laterally extending between the side walls, a carriage body, a drive motor, cam means, a support shaft, a holder member, a first cam follower and means for maintaining the holder member at its erase position. The carriage body is supported on the guide shaft and is movable therealong. The carriage body carries thereon a print hammer and a typed wheel. The drive motor has a drive shaft and is supported on the carriage body. The drive motor is rotatable in a first direction and a second direction opposite the first direction. The cam means is supported on the carriage body and is connected to the drive shaft. The cam means is angularly rotatable about an axis of the drive shaft. The support shaft extends in a lateral direction. The holder member is pivotally supported around the support shaft and is operatively connected to the cam means. The holder member mounts thereon a ribbon cassette and an erase ribbon, and has a lower printing position and an upper erase position in accordance with the pivotal motion of the holder member about the support shaft in response to an angular rotation of the cam means. The first cam follower is provided at the holder member and is engageable with the cam means. The cam means includes a first cam portion contactable with the first cam follower for providing the printing position of the holder member, a second cam portion contactable with the first cam follower for providing the erase position of the holder member, and a third cam portion provided between the first cam portion and the second cam portion for introducing the first cam follower from the first cam portion into the second cam portion when the drive motor is rotated in the first direction. The means for maintaining the first cam follower is adapted for maintaining the first cam follower at a position along the second cam portion in order to maintain the erase position of the holder member.

Preferably, the maintaining means includes a second cam follower provided at the holder member, and a fourth cam portion provided at the cam means and engageable with the second cam follower when the first cam follower is moved into the second cam portion during rotation of the drive motor in the first direction.

In another aspect of the present invention there is provided a printer comprising a pair of side walls, a platen laterally extending between the side walls, a guide shaft laterally extending between the side walls, a carriage body supported on the guide shaft and movable therealong, the carriage body carrying thereon a print hammer and a typed wheel, a drive motor having a drive shaft and supported on the carriage body, the drive motor being rotatable in a first direction and a second direction opposite the first direction, cam means supported on the carriage body and connected to the drive shaft, the cam means being angularly rotatable about an axis of the drive shaft, a support shaft extending in a lateral direction, a holder member pivotally supported around the support shaft and operatively connected to the cam means, the holder member mounting thereon a ribbon cassette and an erase ribbon, and having a lower printing position and an upper erase position in accordance with the pivotal motion of the holder member about the support shaft in response to an angular rotation of the cam means, a cam follower provided at the holder member and being engageable with the cam means, the cam means comprising a first cam portion contactable with the first cam follower for providing the lower printing position of the holder member, a second cam portion contactable with the first cam follower for providing the upper erase position of the holder member, a third cam portion provided between the first cam portion and the second cam portion for introducing the first cam follower from the first cam portion into the second cam portion when the drive motor is rotated in the first direction, and a fourth cam portion connecting the first and second cam portions for introducing the cam follower from the second cam portion directly into the first cam portion without any passage through the third cam portion during rotation of the drive motor in the second direction.

During the printing operation, the first cam follower is slidingly moved along the first cam portion so as to maintain the holder member at its printing position. Further, for the erase operation, upon rotation of the drive motor in the first direction, the first cam follower is slidingly moved into the second cam portion through the third cam portion. In this case, when the first cam follower is moved from the third cam portion to the second cam portion, the second cam follower supported at the holder member is brought into engagement with the fourth cam portion. As a result, the first cam follower is temporarily separated from the second cam surface, so that no frictional resistance is imparted on the first cam follower. Thus, the first cam follower can deeply extend into the second cam portion to ensure the engagement therebetween, to thereby provide stability in erase position.

Further, according to the other aspect of the invention, after the erase operation, the cam follower is slidingly moved from the second cam portion to the first cam portion without any passage of the third cam portion upon rotation of the drive motor in the second direction so as to promptly obtain the print position of the holder member.

DETAILED DESCRIPTION OF THE PREFERRED EMBODIMENT

A printer according to one embodiment of the present invention will hereinafter be described with reference to the drawings. In the illustrated embodiment, the present invention is applied to an electronic typewriter having a single DC motor for performing a printing process, a process for winding a print ribbon in connection with the printing process, an erasing process, and a process for winding an erase ribbon in connection with the erasing process. Further, throughout the specification, the expressions "front", "rear", "above", "below", "right", "left" and "laterally" are used herein to define the various parts when the typewriter is disposed in an orientation in which it is intended to be used.

Figure 1:
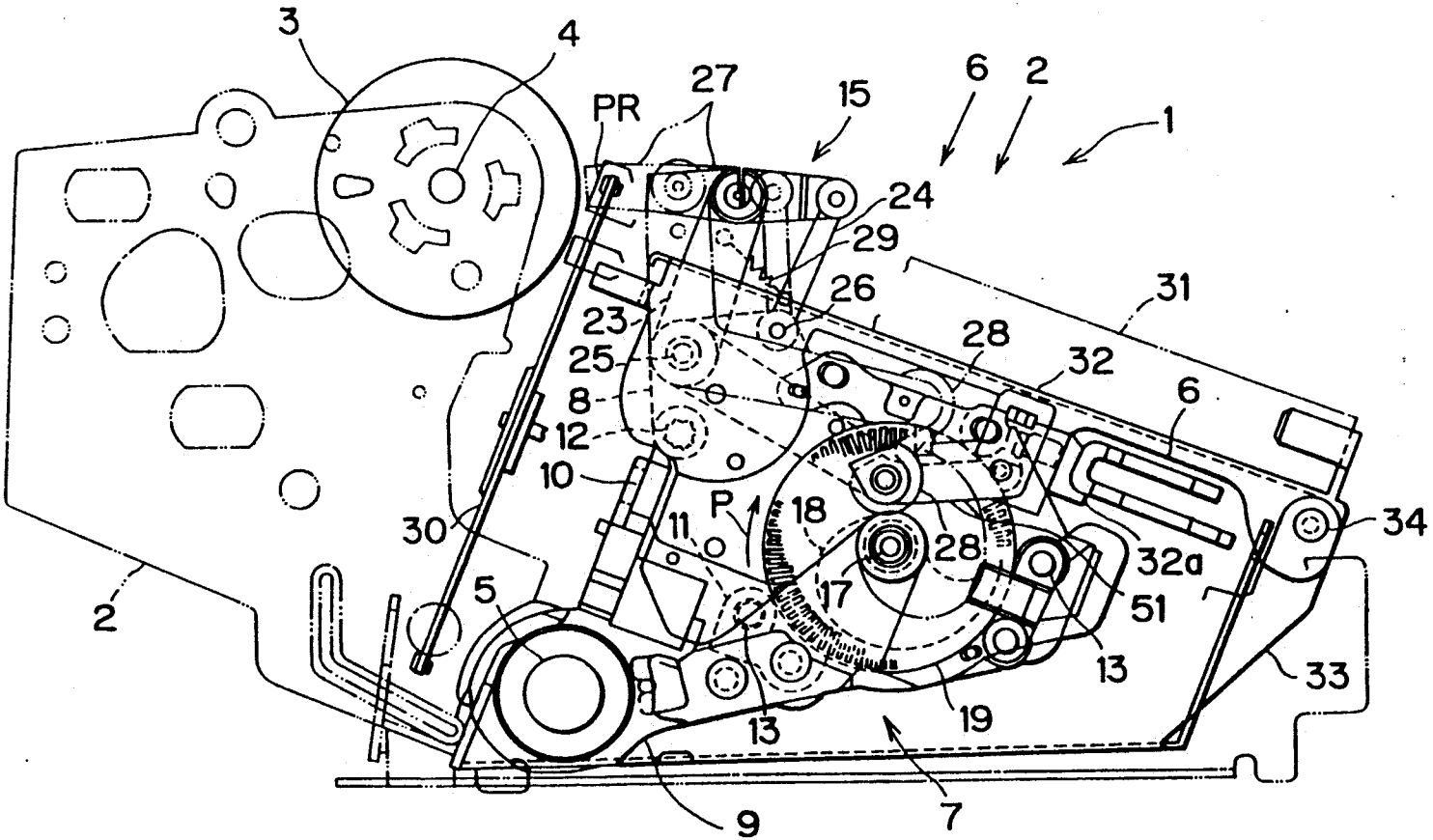
FIG. 1 is a side elevational view showing an internal mechanism of an electronic typewriter.
Figure 2:
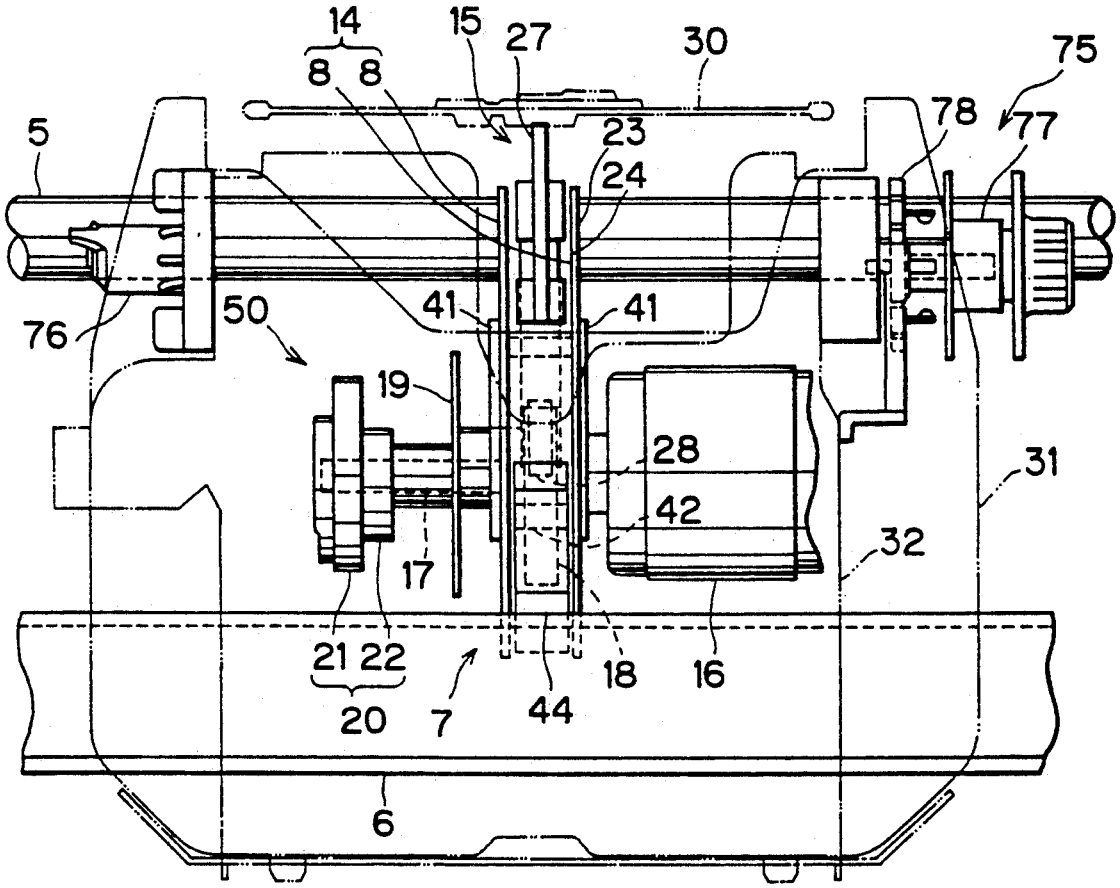
FIG. 2 is a view as viewed in the direction indicated by the arrow 2 in FIG. 1.

As shown in FIGS. 1 and 2, a typewriter 1 has a casing including side wall panels (machine frames) 2 positioned at respective lefthand and righthand ends thereof. A platen 3 is disposed between the side wall panels 2 and rotatably supported thereby in the vicinity of opposite ends of a platen shaft 4. The platen 3 can be rotated about its own axis by a platen drive motor (not shown) and a platen drive mechanism (not shown) through a driven gear (not shown) fixed to the lefthand end of the platen shaft 4.

Between the side wall panels 2, there are disposed a guide shaft 5 and a guide member 6 of a substantially U-shape as viewed in side elevation. The guide shaft 5 and the guide member 6 extend in a direction parallel to the platen 3. A carriage 7 is supported on the guide shaft 5 and the guide member 6 for lateral movement therealong. Now, the carriage 7 will be described below with reference to FIGS. 1 through 5.

A pair of lefthand and righthand main frames 8, which are spaced laterally from each other and each in the form of a substantially rectangular plate, are positioned between the guide shaft 5 and the guide member 6. The main frames 8 extend in a direction normal to the guide shaft 5 and the guide member 6. A support member 9 is laterally movably and rotatably supported on the guide shaft 5 for supporting the main frames 8. The support member 9 has first and second support arms 10 and 11. The main frames 8 are supported on upper ends of the first and the second support arms 10, 11 which serve as spacers positioned between the main frames 8 and 8. More specifically, the main frames 8 are fixed by pins 12, 13 to the outer surfaces of the upper ends of the first and second support arms 10, 11. The main frames 8 jointly serve as a carriage body 14.

A print mechanism 15 will now be described below. An auxiliary frame 33 is laterally movably supported on the guide shaft 5 for movement therealong. A print ribbon is stored in a ribbon cassette 31 that is placed on a holder member 32 vertically swingably supported by a support shaft 34 on the auxiliary frame 33. The holder member 32 has a printing position and an erasing position in accordance with its pivotal motion about an axis of the support shaft 34. A DC motor 16 is nonrotatably supported on the righthand main frame 8. The DC motor 16 has a drive shaft 17 extending to the left through the main frames 8. To the drive shaft 17, there are secured, successively from the motor 16, a print cam 18, an encoder disk 19, a ribbon supply cam 22 and a lifter cam 21. The print cam 18 is positioned between the main frames 8 and 8 and has substantially whirl-shape in side elevation for moving a print hammer 27(described later) toward and away from the platen 3. The encoder disk 19 has a plurality of slits defined in an outer periphery thereof. The ribbon supply cam 22 is adapted for supplying the print ribbon stepwise in increments. The lifter cam 21 is adapted for lifting the holder member 32 into the erasing position. The print cam 18, the ribbon supply cam 22, and the lifter cam 21 jointly serve as a cam assembly 20, and the ribbon supply cam 22 and the lifter cam 21 are provided integrally with each other as a cam body. In FIG. 1, a printing start position for the print cam 18 is shown by a dotted line, and an origin setting position for the print cam 18 is shown by two-doted chain line.

A turn lever 23 is provided which has substantially L-shape as viewed in side elevation and a link 24 is also provided on the main frames 8. A central portion of the turn lever 23 and a lower end portion of the link 24 are angularly movably supported on upper rear end portions of the main frames 8 by pins 25, 26, respectively. The print hammer 27 that extends perpendicularly to the platen 3 and confronts the platen 3 is angularly movably supported at its rear end on the upper end of the link 24, and at its center on the upper end of the turn lever 23. A cam follower 28 is rotatably mounted on the front end of the turn lever 23. A tension spring 29 is connected between an upper end portion of the turn lever 23 and a lower end portion of the link 24 for normally urging the cam follower 28 to be held against the cam surface of the print cam 18. A daisy wheel 30 is provided rotatably by a wheel drive motor (not shown) and a wheel drive mechanism (not shown). The carriage 7 is reciprocally movable along the platen 3 by a carriage drive motor(not shown) and a drive mechanism (not shown) through a drive wire (not shown).

When the motor 16 is energized to rotate the drive shaft 17 a predetermined angle in the printing direction indicated by the arrow P in FIG. 1, the cam follower 28 is lifted along the cam surface of the print cam 18. The turn lever 23 is turned in a counterclockwise direction about the shaft 25, forcing the print hammer 27 to press a type character of the daisy wheel 30 and the print ribbon against the platen 3.

Figure 4:
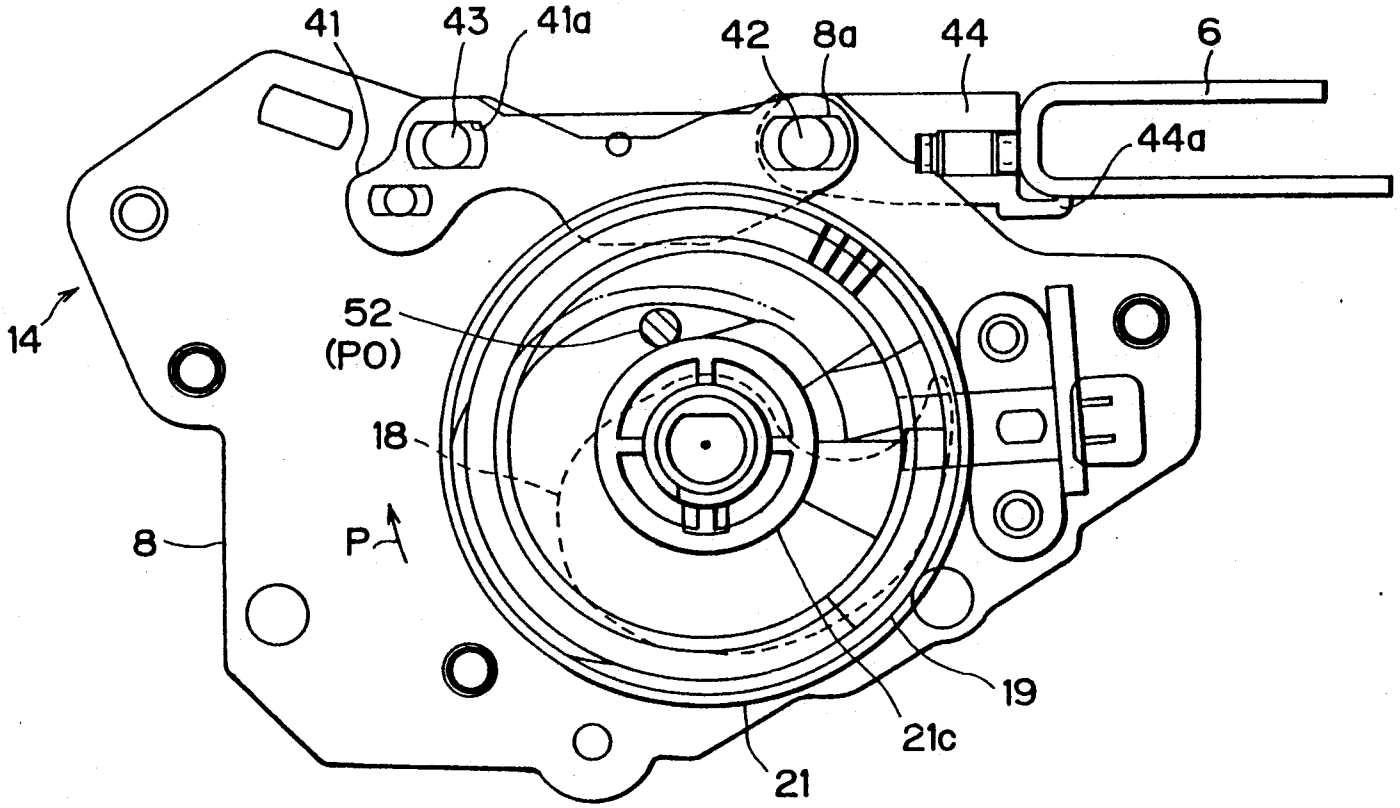
FIG. 4 is a side elevational view showing a main frame and an adjusting plate.

A pair of adjusting plates 41 are adjustably fixed to outer sides of upper portions of the main frames 8 and extend in frontward/rearward direction of the printer. Each of the main frames 8 is formed with oblong holes 8*a* as best shown in FIG. 4 at an upper front portion thereof. The oblong hole 8*a* extends in frontward/rearward direction of the printer. A support shaft 42 is fixed to front ends of the adjusting plates 41, and extends through the oblong holes 8*a* of the respective main frames 8. The adjusting plates 41 have oblong holes 41*a* defined respectively in rear ends thereof. The oblong hole 41*a* extends in frontward/rearward direction of the printer. The main frames 8 and the adjusting plates 41 are joined to each other by a screw 43 extending through the oblong holes 41*a*. An abutment member 44 is angularly movably supported at its rear end on the support shaft 42, and has an engaging member 44*a* held in slidable engagement with a rear end of the guide member 6.

An erase mechanism 50 lifts the holder member 32 from a printing position to an erasing position to bring an erase ribbon in confronting relation to the print hammer 27 for erasing a printed character. The erase mechanism 50 will now be described below with reference to FIGS. 1 through 5.

Figure 5:
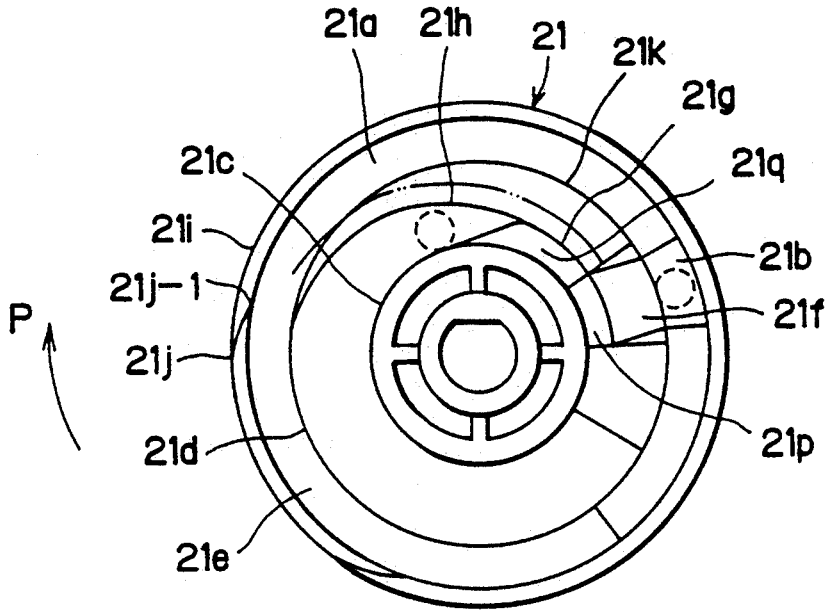
FIG. 5 is a left side view showing a lifter cam.
Figure 6:
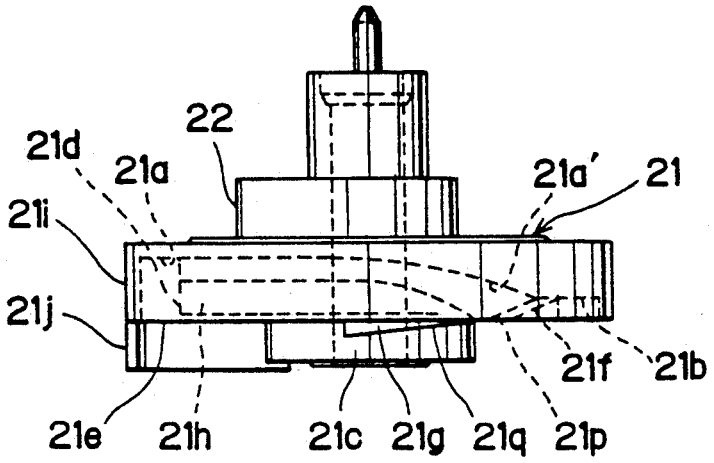
FIG. 6 is a top plan view showing the lifter cam.
Figure 7:
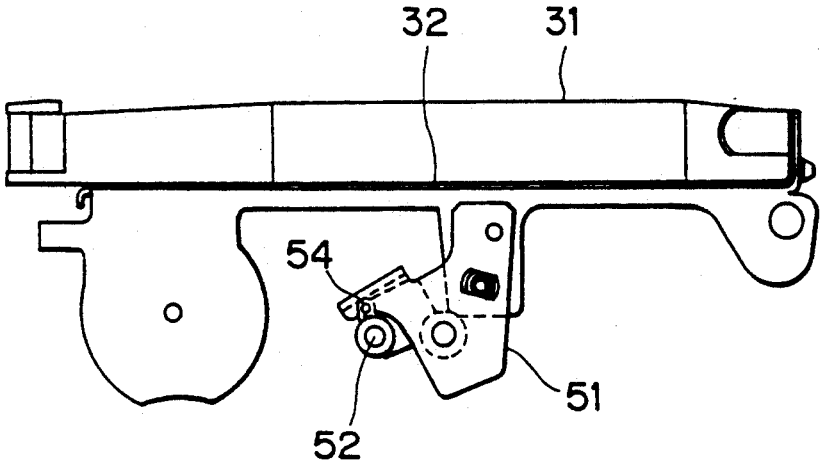
FIG. 7 is a side elevational view showing a geometrical relationship among a holder member, a support member and first and second follower pins.

The lifter cam 21 and the ribbon supply cam 22 are provided integrally with each other as a cam body, as described above. As best shown in FIGS. 5 and 6, the lifter cam 21 has a circular side 21*e* (lefthand side is shown as viewed from an arrow X in FIG. 3) and an outer peripheral surface 211. At the circular side 21*e* and adjacent the outer peripheral surface, a circular groove 21*a* is formed having an equal radius of curvature along its curvature length. A part of the circular groove 21*a* has a shallow depth portion 21*b*. A bottom of the shallow groove portion 21*b* is formed contiguous with a bottom of the circular groove 21*a* as shown by 21*a*'. A portion radially inner side of the circular groove 21*a* constitute a second cam 21*d* (corresponding to the outer cam in the proposed inhouse device described above). Further, a circular first cam 21c protrudes from the second cam 21d in concentrical relation thereto. The first cam 21c has a radius smaller than that of the second cam 21d.

The second cam 21d is formed with a slant portion 21f. That is, a portion of a radially inner side of and adjacent to the shallow groove portion 21b is cut away so as to form the slant portion 21f. The slant portion 21f is inclined from a position adjacent the first cam 21c to a position adjacent the shallow groove portion 21b (the depth being gradually deeper toward the shallow groove portion 21b).

Within a range of 120° in a counterclockwise direction with respect to the slant portion 21f, a second slant cam 21h is formed. Radius of the second slant cam 21h is gradually increased in the counterclockwise direction such that the radius is initially two-third of a radius of the second cam 21d at a position adjacent to the slant portion 21f and is gradually increased toward an outer contour of the second cam 21d to be equal to the radius thereof. Further, the second slant cam 21h is slanted from the second cam 21d to the circular groove 21a to a half depth thereof. Accordingly, an outer contour of the second slant 21h is coincident with the outer contour of the second cam 21d, and serves as a connecting portion 21k which connects the second cam 21d to the shallow groove portion 21b.

Within a range of 45° in the counterclockwise direction with respect to the slant portion 21f, a first slant cam 21g is formed. The first slant cam 21g protrudes from the circular side 21e by half of the projection length of the first cam 21c. The first slant cam 21g starts from an outer peripheral surface of the first cam 21c and radius of the first slant cam 21g is gradually increased toward the outer contour of the second am 21d, and the first slant cam 21g ends at a position one-third of a distance between the outer peripheral surface of the first cam 21c and the outer contour of the second cam 21d. Thus, the first slant cam 21g is connected to the second slant cam 21h.

Incidentally, the above described first and second slant cams 21g and 21h constitute in combination a third cam, and the above described shallow groove portion 21b, the slant portion 21f and the connecting portion 21k constitute in combination a fourth cam.

The outer peripheral surface 21i of the lifter cam 21 has a protruded portion to defined an outer peripheral cam 21j. The protruded portion protrudes from the outer peripheral surface 21i in an axial direction of the cam 21, and a cam length is about one-forth of the entire periphery 21i. Further, the outer peripheral cam 21j starts at a point 21j-l which is positioned adjacent an extension line connecting between a cam center and a joining point 21m defined between the second slant cam 21h and the outer contour of the second cam 21d. The outer peripheral cam 21j extends in the counterclockwise direction from the point 21j-l. The outer peripheral cam is adapted to engage a second follower pin 54 described later.

A support member 51 is provided whose upper end is fixed to a lefthand side wall 32a of the holder member 32. A first follower pin 52 is held against the lefthand side 21e of the lifter cam 21. The first follower pin 52 is laterally movably supported on a lower end of the support member 51, and is resiliently urged to the right (FIG. 3) at all times by a coil spring 53. The first follower pin constitutes a first cam follower.

In the print start phase, the first follower pin 52 has its tip end held against, from above, the first cam surface 21c, as shown in FIG. 4, to hold the holder member 32 in a printing position (reference angular position) shown in FIG. 1. At this time, the tip end of the first follower pin 52 is positiond leftward of the slant portion 21f. The angular moving amount of the holder member 32 is determinative by the vertical motion of the first follower pin 52. The positional relationship between the print cam 18, the lifter cam 21, and the first follower pin 52 in the printing start position is shown in FIG. 4.

The support member 51 also supports a second follower pin 54 extending in parallel with the first follower pin 52 toward the lifter cam 21. The second follower pin 54 is engageable with the outer peripheral cam 21j in accordance with the rotation of the lifter cam 21. The projecting position of the second follower pin 54 is determined in such a manner that the first follower pin 52 is slightly spaced away from the second cam 21d when the second follower pin 54 engages the outer peripheral cam 21j. The second follower pin 54 serves as a second cam follower.

When the motor 16 is energized to rotate the motor shaft 17 by a predetermined angle from a phase angle at the printing start position shown in FIG. 4 in the direction (hereinafter referred to as "nonprinting direction") opposite to the printing direction P, the first follower pin 52 is displaced upwardly by the first slant cam surface 21g. Therefore, the holder member 32 is also angularly moved upwardly by a distance depending on the distance by which the first follower pin 52 is moved upwardly. When the motor shaft 17 of the motor 16 is thereafter rotated in the printing direction P, the first follower pin 52 moves along the second slant cam surface 21h onto the second cam 21d. Thus, the holder member; 32 is angularly moved further upwardly into the erasing position.

Figure 10:
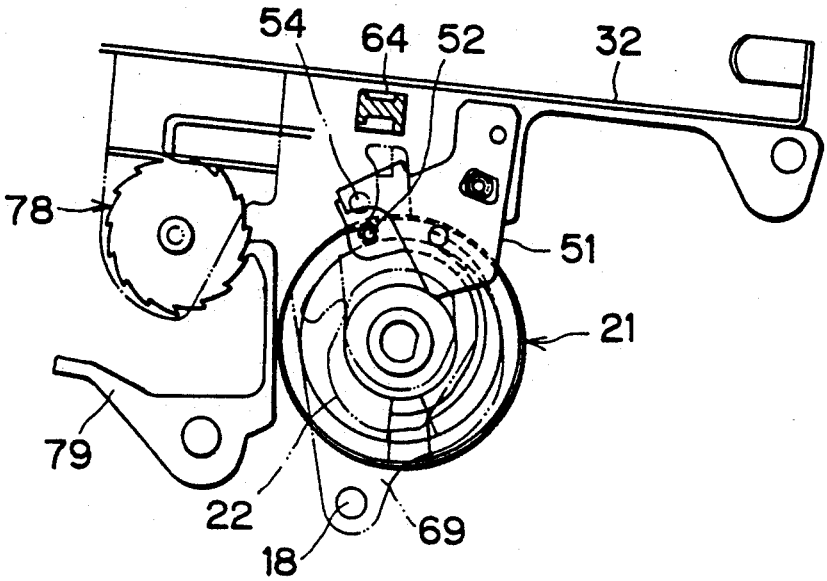
FIG. 10 is a fragmentary side elevational view showing an internal mechanism relevant to that shown in FIG. 9 but showing a state where the first follower pin is moved onto a second cam.

When the first follower pin 52 reaches a connecting portion 21m between the second slant cam 21h and the second cam 21d, the second follower pin 54 engages the outer peripheral cam 21j. During engagement phase between the second follower pin 54 and the outer peripheral cam 21j, the first follower pin 52 is moved radially outwardly so as to be slightly spaced away from the second cam 21d as shown in FIG. 10. Since the first follower pin 52 is spring biased, the first follower pin 52 can be further moved, so that its tip end can be brought into abutment with a bottom surface of the groove 21a.

Thus, even if an axial movement of the first follower pin 52 may be restrained by the frictional resistance between the first follower pin 52 and the first slant cam 21g and between the first follower pin 52 and the second slant cam 21h, the first follower pin 52 can surely be moved in its axial direction upon movement of the first follower pin 52 away from the second cam 21d in response to the engagement of the second follower pin 54 with the outer peripheral cam 21j. Accordingly, it is possible to prevent the first follower pin 52 from being returned back to the first and second slant cams 21g and 21h. The holder member 32 can thus maintain its erase position.

After the erase operation, if the lifter cam 21 is rotated in the printing direction P, the first follower pin 52 slidingly moves along the outer contour of the second cam 21d to reach the shallow groove portion 21a through the connecting portion 21k, and then reaches the first cam 21c through the slanting portion 21f. Since the holder member 32 is imparted with a downward force because of its own weight and a weight of the ribbon cassette 31 and because of a biasing force toward the reference swinging position by way of a spring (not shown), the first follower pin 52 reaching the shallow groove portion 21*a* is immediately moved onto the first cam 21*c* through the slanting portion 21*f*. Then, the lifter cam 21 is rotated in the non-printing direction for returning the holder member to its non printing position to thus complete erase operation.

Figure 3:
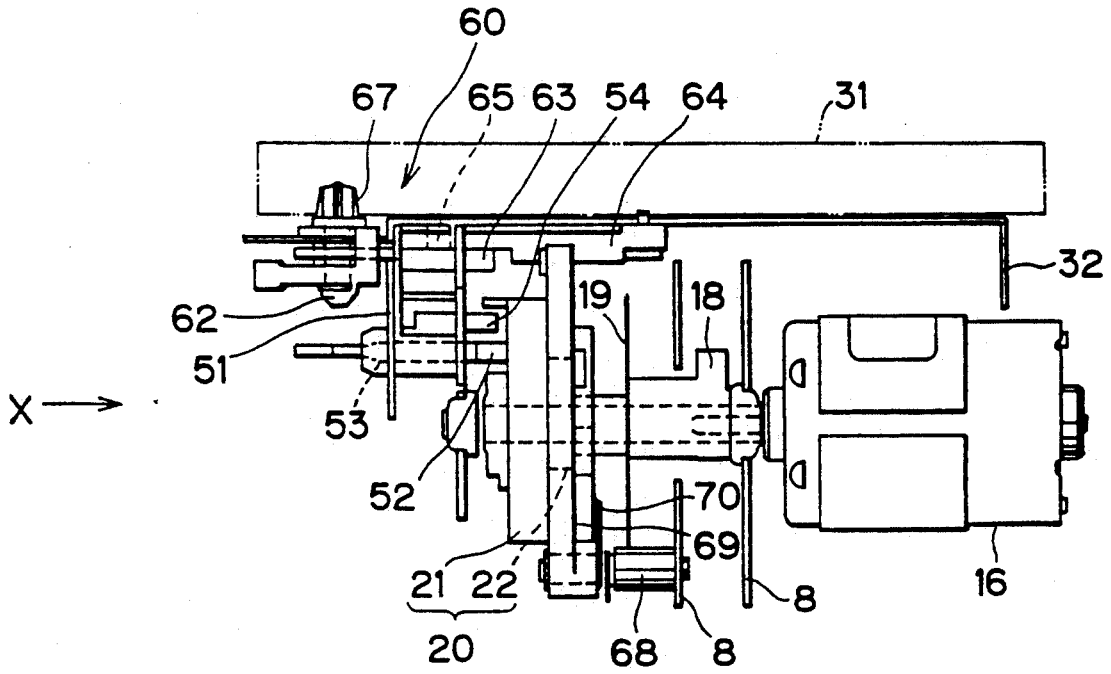
FIG. 3 is a fragmentary front elevational view showing the internal mechanism of the electronic typewriter.

A print ribbon takeup mechanism 60 for winding a length of the print ribbon on a takeup spool in each printing process will be described below with reference to FIGS. 3, 8, and 11.

Figure 11:
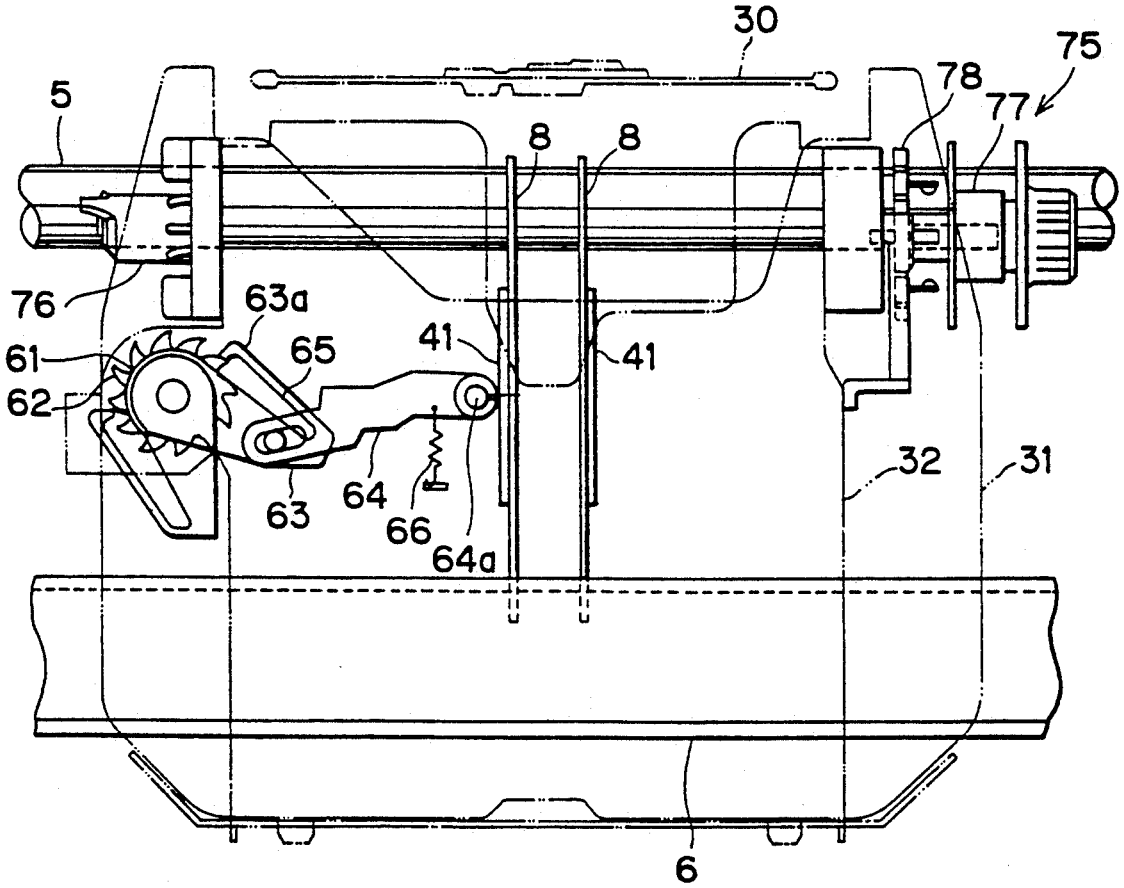
FIG. 11 is a side view particularly showing a print ribbon takeup mechanism.

A ratchet 61 having a plurality of teeth is rotatably supported on a lower lefthand end portion of the holder member 32 by a pin 62 (FIG. 11). Further, first through third swing members 69, 64 and 63 are provided. The third swing member 63 is rotatably supported on the pin 62 and has a feed pawl 63*a*. The third swing member 63 is connected by a coupling pin 65 to the second swing member 64 that is angularly movably mounted on the holder member 32 at a pivot shaft 64*a*. The second swing member 64 is normally urged to turn counterclockwise in FIG. 11 (upwardly from a drawing sheet with respect to FIG. 3) under the resiliency of a tension spring 66. A takeup spool 67 is fixed to the pin 62.

Figure 8:
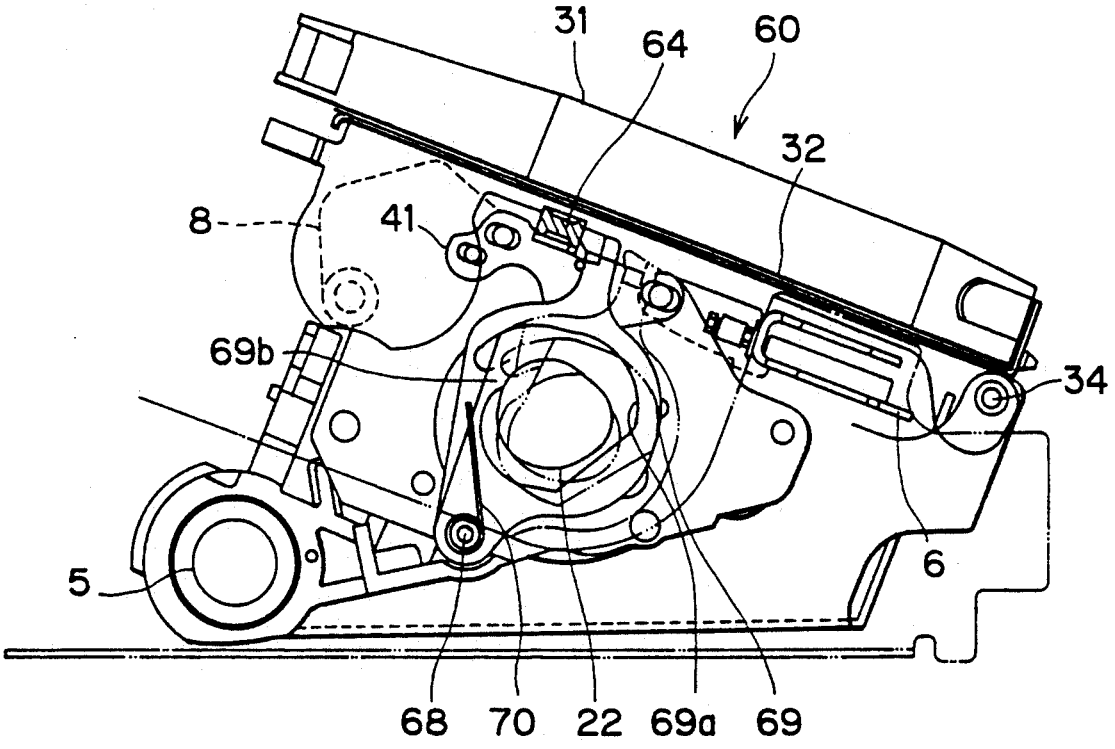
FIG. 8 is a fragmentary side elevational view showing an internal mechanism.

Further, as best shown in FIG. 8, the first swing member 69 is provided which has a lower end angularly movably supported on a pivot pin 68 fixed to the lefthand main frame 8 in positional alignment with the ribbon supply cam 22. The first swing member 69 has an upper end held against the second swing member 64 near a proximal end thereof from the front side thereof. The first swing member 69 has a substantially circular hole 69*a* defined therein with the ribbon supply cam 22 positioned in the circular hole 69*a*. A projection 69*b* extends inwardly from the circular hole 69*a*, so that the projection 69*b* can abut the profile of the ribbon supply cam 22. The first swing member 69 is normally urged to turn clockwise (FIG. 9) under the resiliency of a torsion spring 70 (FIG. 8) coiled around the pivot pin 68 so that the projection 69*b* of the first swing member 69 abuts against a portion of the ribbon supply cam 22 at all times.

Figure 9:
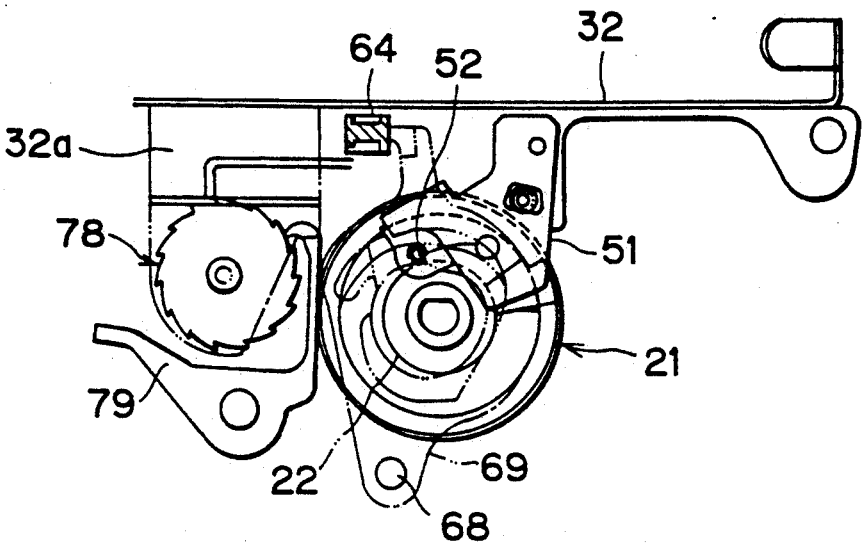
FIG. 9 is a fragmentary side elevational view showing an internal mechanism at its print start position.

When the motor 16 is energized to rotate the drive shaft 17 in the printing direction P, the ribbon supply cam 22 is rotated so that the first swing member 69 is turned about the pivot pin 68 in the counterclockwise direction in FIG. 9 (from a forward position shown by a two dotted chain line position to a retracting position shown by a solid line in FIG. 8) in accordance with the cam profile of the ribbon supply cam 22 through the projection 69*b*. Therefore, the second swing member 64 is turned in the clockwise direction in FIG. 11 (downwardly to the drawing sheet in FIG. 3) because of the abutment with the upper portion of the first swing member 69. Thus, the third swing member 63 is turned in the counterclockwise direction in FIG. 11 (upwardly from the drawing sheet in FIG. 3), causing the feed pawl 63*a* to turn the ratchet 61 by an angular interval corresponding to one tooth of the ratchet 61. Immediately prior to the printing operation, the print ribbon is fed stepwise in a predetermined increment by the rotation of the takeup spool 67.

An erase ribbon takeup mechanism 75 for winding a length of the erase ribbon on a takeup spool in an erasing process will be described below with reference to FIGS. 2 and 9.

An erase ribbon supply spool 76 is rotatably mounted on the side wall 32*a* of the holder member 32 at its rear end, and an erase ribbon takeup spool 77 is rotatably mounted on a righthand side wall of the holder member 32 at its rear end. The takeup spool 77 is connected to a ratchet 78 having a plurality of teeth. A feed pawl 79 for turning the ratchet 78 one tooth at a time is vertically mounted on the auxiliary frame (not shown) behind the ratchet 78.

It is assumed that the phase angle of the motor 16 at the printing start position is 0°. As shown in FIGS. 9 through 12, when the motor 16 is energized to turn the drive shaft 17 from the phase angle of 0° by about 55° in the non-printing direction, i.e., by a phase angle of −55°, the first follower pin 52 is moved upwardly along the first slant cam 21*g* from about a phase angle of −5° to about a phase angle of −43°, and thereafter is positioned on the second slant cam surface 21*h*. At this time, the first follower pin 52 is lifted about 2 mm from the first cam surface 21*c*. Incidentally, in FIGS. 9 and 10, the lifter cam 21, the ribbon supply cam 22 and the first swing member 69 are shown by a solid line, a dotted chain line, and two-dotted chain line, respectively.

When the drive shaft 17 of the motor 16 is rotated back from the phase angle of −55° to the phase angle of +90° in the printing direction P, the first follower pin 52 moves on the second slant cam surface 21*h* until it reaches the second cam 21*d*. (see FIG. 10). At this time, the holder member 32 is shifted into the erasing position in which the erase ribbon confronts the print hammer 27. In this case, the second follower pin 54 is brought into engagement with the outer peripheral cam 21*j* as described above, and therefore, the first follower pin 52 is slightly moved away from the second cam 21*d* as shown by P3 in FIG. 12. Thus, the first follower pin 52 can be moved toward the first groove 21*a* so that the tip end of the pin 52 can abut the groove bottom.

When the first follower pin 52 is positioned at a position P1 (for example, 10°) during its moving phase, the feed pawl 79 is brought into meshing engagement with the ratchet 78, and at the position P2 (for example, 60°), the ratchet 78 is angularly rotated by its one tooth. That is, in this instance, the erase ribbon is taken-up by a predetermined length over the takeup spool 77 for stepwise feeding. Here, the first follower pin 52 is positioned about 5.7 mm above the first cam 21*c*.

Then, the motor 16 is angularly rotated in the printing direction from the +90° position to +270° position and then reversely rotated to −90° position in the non printing direction, so that the first follower pin 52 is moved from the second cam 21*d* to the shallow groove portion 21*b* through the connecting portion 21*k*. The first follower pin 52 is then moved downwardly to the first cam 21*c* through the slanting portion 21*f* when the motor 16 is rotated to −90° position. In accordance with the downward movement of the pin 52, the holder 32 is lowered to its printing position (see P6). Meanwhile, the feed pawl 79 is disengaged from the ratchet 78. Further, during this downward movement of the first follower pin 52, the first follower pin 52 is axially moved by a distance between the shallow bottom portion 21*b* and a face 21*p* while the tip end of the first follower pin 52 successively contacts the faces 21*b*, 21*f* and 21*p*. Then the pin 52 is contacted with a face 21*q* and 21*e*.

Figure 12:
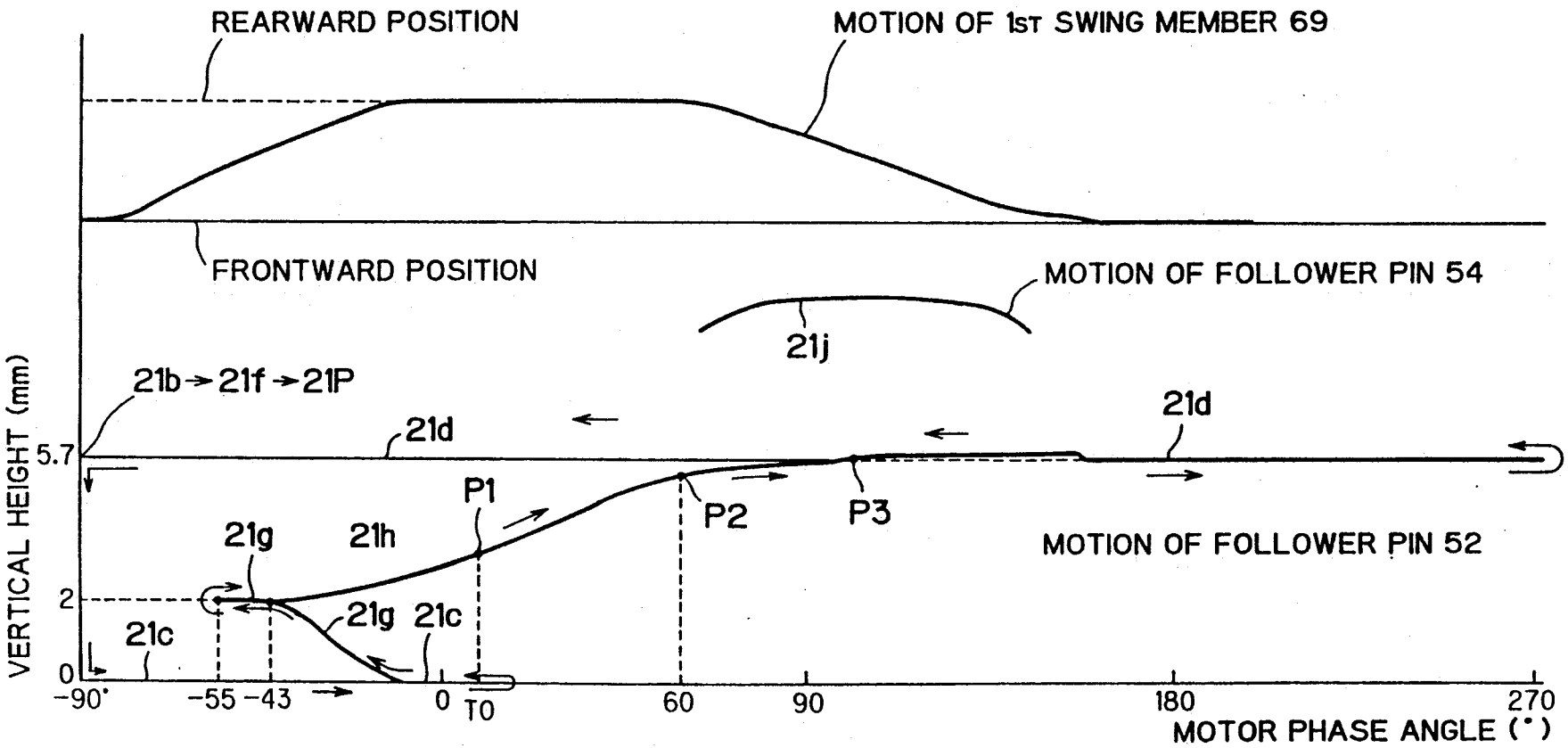
FIG. 12 is a diagram showing a motion curves of the follower pin and a first swing member in connection with the angular rotation of the drive motor.

As shown in FIG. 12, during the erasing operation, the first swing member 69 is angularly moved from its rearward position shown in the solid line in FIG. 8 in the clockwise direction in response to the rotation of the drive motor 16 from 0° to −55°. Then, the first swing member 69 is angularly rotated in the counterclockwise direction to the rearward position shown by the solid line in FIG. 8 in response to the rotation of the motor 16 from −55° to +90°. Further, the first swing member 69 is moved from the rearward position indicated by the solid line to the forward position indicated by the two-dotted chain line in FIG. 8 until the drive motor 16 is angularly rotated to −90° in the non printing direction. Thereafter, the first swing member is angularly rotated in the counterclockwise direction to return back to the rearward position.

When the first follower pin 52 is lowered onto the first cam 21*c* upon completion of the rotation of the drive motor 16 to −90° in the non-printing direction, the holder member 32 can be moved from its erase position to the printing position. In this case, the first swing member 69 is moved to its forward position far away from the second swing member 64. Therefore, it is possible to prevent the second swing member 64 from riding on the first swing member 69. Consequently, the holder member 32 can be surely returned back to the printing position because of no mechanical interference between the first and second swing member. Thus, the holder member 32 can be lowered to the printing position upon completion of the erase operation.

More specifically, in accordance with the movement of the first follower pin 52 through the cam faces 21*b*, 21*f* and 21*p*, the holder member 32 is pivoted downwardly from its erase position to the printing position (see P6). In this case, since the second swing member 64 is supported to the holder member 32, the second swing member 64 is also moved downwardly together with the holder member. Accordingly, if the first swing member 69, which is supported to the frame 8, is still positioned at its retracted position, the second swing member 64 may ride onto the top end face of the first swing member 69. As a result, further downward movement of the holder member 32 is prevented.

The present embodiment can avoid this drawback by pivotally moving the first swing member 69 frontwardly (away from the second swing member) because of the engagement between the cam 22 and the cam face 69*a* during downward pivotal movement of the holder member 32. Consequently, the holder member 32 can surely be placed at its printing position because of no mechanical interference between the first and second swing members at the zone P6.

Then, the motor 16 is rotated to 0° position in the printing direction P. In this case, the first follower pin 52 is merely moved along the cam 21*c*.

In accordance with the present invention, the first cam follower can surely be engaged with the second cam so as to surely position the erase ribbon at its erase position without fail. Further, in the present invention, the holder member positioned at its erase position can surely be moved to its printing position after the erase operation.

While the invention has been described with reference to specific embodiment thereof, it would be apparent to those skilled in the art that various changes and modifications may be made therein without departing from the spirit and scope of the invention. For example, a gear transmission mechanism can be used for transmitting rotation of the drive motor 16 to the cam body 20. Further, instead of the lifer cam 21 of the above described embodiment, various cams, which may be integral or separate, can be used.

What is claimed is:

1. A printer comprising:
a pair of side walls;
a platen laterally extending between the side walls;
a guide shaft laterally extending between the side walls;
a carriage body supported on the guide shaft and movable therealong, the carriage body carrying thereon a print hammer and a typed wheel;
a drive motor having a drive shaft and supported on the carriage body, the drive motor being rotatable in a first direction and a second direction opposite the first direction;
cam means supported on the carriage body and connected to the drive shaft, the cam means being angularly rotatable about an axis of the drive shaft;
a support shaft extending in a lateral direction;
a holder member pivotally supported around the support shaft and operatively connected to the cam means, the holder member mounting thereon a ribbon cassette and an erase ribbon, and having a lower printing position and an upper erase position in accordance with the pivotal motion of the holder member about the support shaft in response to an angular rotation of the cam means;
a first cam follower provided at the holder member and being engageable with the cam means;
the cam means comprising;
a first cam portion contactable with the first cam follower for providing the printing position of the holder member;
a second cam portion contactable with the first cam follower for providing the erase position of the holder member; and
a third cam portion provided between the first cam portion and the second cam portion for introducing the first cam follower from the first cam portion into the second cam portion when the drive motor is rotated in the first direction; and
means for maintaining the first cam follower at a position along the second cam portion in order to maintain the erase position, said maintaining means comprising:
a second cam follower provided at the holder member; and
a fourth cam portion provided at the cam means and engageable with the second cam follower when the first cam follower is moved into the second cam portion during rotation of the drive motor in the first direction.

2. The printer as claimed in claim 1, wherein the first and second cam followers are positioned opposite the drive motor with respect to the cam means, and the first cam follower is biased in an axial direction thereof toward the drive motor for ensuring a surface contact between the first cam follower and the cam means.

3. The printer as claimed in claim 2, wherein the first cam portion has a circular shape having a first radius, and the second cam portion has a circular shape concentrical with the first cam portion and having a second radius larger than the first radius, and a fourth cam portion has an arcuate shape concentrical with the first and second cam portions and having a radius larger than the second radius, the first cam portion being positioned nearer to the first cam follower than the second cam portion is to the first cam follower, and the second cam follower being ridable over the fourth cam portion for temporarily releasing a surface contact between the first cam follower and the second cam portion for releasing frictional contact therebetween and for urging the first cam follower deeply into the second cam portion.

4. The printer as claimed in claim 3, wherein the carriage body comprises first and second frames extending in a vertical direction in parallel with each other and movable along the guide shaft, the drive motor being supported on a front side of the first frame, and the drive shaft extending through the first and second frames, and the cam means being positioned at a rear side of the second frame, the first and second cam followers being positioned at a rear side of the cam means.

5. The printer as claimed in claim 4, further comprising:

a print cam mounted on the drive shaft and positioned between the first and second frames; and lever means pivotally supported on one of the first and second frames for supporting the print hammer, the lever means having a portion in contact with the print cam for moving the print hammer toward and away from the platen in response to a rotation of the print cam.

6. The printer as claimed in claim 4, further comprising a print ribbon take-up mechanism comprising:

a ribbon supply cam mounted on the drive shaft and provided integrally with the cam means;

a first swing member having a lower end portion pivotally supported to one of the first and second frames, an intermediate portion engageable with the ribbon supply cam, and an upper portion;

a second swing member pivotally supported on the holder member, the upper portion of the first swing member being abuttable on the second swing member for swinging the latter;

a third swing member pivotally supported on the holder member by a pin and loosely connected to the second swing member; and a takeup spool fixed to the pin, the takeup spool being stepwisely rotatable about an axis of the pin in accordance with the pivotal motion of the third swing member.

7. The printer as claimed in claim 6, wherein the first swing member has a first pivot position spaced away from the second swing member and avoiding mechanical interference with the second swing member and has a second pivot position abutting the second swing member for rotating the takeup spool.

8. The printer as claimed in claim 7 wherein the cam means further comprises a fifth cam portion for introducing the first cam follower from the second cam portion directly into the first cam portion without any passage through the third cam portion during rotation of the drive motor in the second direction.

9. A printer comprising:

a pair of side walls;

a platen laterally extending between the side walls;

a guide shaft laterally extending between the side walls;

a carriage body supported on the guide shaft and movable therealong, the carriage body carrying thereon a print hammer and a typed wheel;

a drive motor having a drive shaft and supported on the carriage body, the drive motor being rotatable in a first direction and a second direction opposite the first direction;

cam means supported on the carriage body and connected to the drive shaft, the cam means being angularly rotatable about an axis of the drive shaft;

a support shaft extending in a lateral direction;

a holder member pivotally supported around the support shaft and operatively connected to the cam means, the holder member mounting thereon a ribbon cassette and an erase ribbon, and having a lower printing position and an upper erase position in accordance with the pivotal motion of the holder member about the support shaft in response to an angular rotation of the cam means;

a cam follower provided at the holder member and being engageable with the cam means;

the cam means comprising:

a first cam portion contactable with the cam follower for providing the lower printing position of the holder member;

a second cam portion contactable with the first cam follower for providing the upper erase position of the holder member;

a third cam portion provided between the first cam portion and the second cam portion for introducing the cam follower from the first cam portion into the second cam portion when the drive motor is rotated in the first direction; and a fourth cam portion connecting the first and second cam portions for introducing the cam follower from the second cam portion directly into the first cam portion without any passage through the third cam portion during rotation of the drive motor in the second direction.

10. The printer as claimed in claim 9, wherein the carriage body comprises first and second frames extending in a vertical direction in parallel with each other and movable along the guide shaft, the drive motor being supported on a front side of the first frame, and the drive shaft being extending through the first and second frames, and the cam means being positioned at a rear side of the second frame, the cam follower being positioned at a rear side of the cam means.

11. The printer as claimed in claim 10, further comprising a print ribbon take-up mechanism comprising:

a ribbon supply cam mounted on the drive shaft and provided integrally with the cam means;

a first swing member having a lower end portion pivotally supported to one of the first and second frames, an intermediate portion engageable with the ribbon supply cam, and an upper portion;

a second swing member pivotally supported on the holder member, the upper portion of the first swing member being abuttable on the second swing member for swinging the latter, the ribbon supply cam providing a first pivot position of the first swing member away from the second swing member and a second pivot position abuttable to the second swing member;

a third swing member pivotally supported on the holder member by a pin and loosely connected to the second swing member, and a takeup spool fixed to the pin, the takeup spool being stepwisely rotatable about an axis of the pin in accordance with the pivotal motion of the third swing member.

12. The printer as claimed in claim 11, wherein the first swing member has the first pivot position spaced away from the second swing member and avoiding riding of the second swing member onto the first swing member when the holder member is downwardly moved into its printing position from its erase position, the first swing member having the second pivot position for urging the second swing member to thereby rotate the takeup spool when the holder member has the printing position.

13. The printer as claimed in claim 12, wherein the cam follower is passable through the fourth cam portion when the first swing member has the first pivot position.

* * * * *